US009833718B2

(12) United States Patent
De-Gol

(10) Patent No.: US 9,833,718 B2
(45) Date of Patent: Dec. 5, 2017

(54) MOVABLE SCREEN

(71) Applicant: Robocoaster Limited, Kingswinford, West Midlands (GB)

(72) Inventor: Gino De-Gol, Kingswinford (GB)

(73) Assignee: ROBOCOASTER LIMITED (GB)

( * ) Notice: Subject to any disclaimer, the term of this patent is extended or adjusted under 35 U.S.C. 154(b) by 0 days.

(21) Appl. No.: 15/036,359

(22) PCT Filed: Nov. 18, 2014

(86) PCT No.: PCT/GB2014/053397
§ 371 (c)(1),
(2) Date: May 12, 2016

(87) PCT Pub. No.: WO2015/071693
PCT Pub. Date: May 21, 2015

(65) Prior Publication Data

US 2016/0271503 A1 Sep. 22, 2016

(30) Foreign Application Priority Data

Nov. 18, 2013 (GB) ..... 1320319.5

(51) Int. Cl.
*A63G 31/16* (2006.01)
*A63J 25/00* (2009.01)

(52) U.S. Cl.
CPC ..... *A63G 31/16* (2013.01); *A63J 25/00* (2013.01)

(58) Field of Classification Search
CPC ..... A63G 31/00; A63G 31/02; A63G 31/04; A63G 31/12; A63G 31/16; G09G 5/00; A63J 5/00; A63J 5/12; A63J 1/00; A63J 1/02; A63J 25/00; A63J 2005/002
USPC .... 472/27, 28, 43, 59–61, 130; 345/1.1, 1.2, 345/1.3, 1.4, 2.3, 87, 204.31
See application file for complete search history.

(56) References Cited

U.S. PATENT DOCUMENTS 5,336,132 A * 8/1994 Murakami ..... G09B 9/063 104/78
5,669,821 A * 9/1997 Prather ..... A63G 31/16 104/78

(Continued)

FOREIGN PATENT DOCUMENTS

KR 10-2012-0082998 7/2012

OTHER PUBLICATIONS

International Preliminary Report on Patentability from corresponding PCT Application No. PCTGB2014/053397, dated Jun. 2, 2016.

(Continued)

*Primary Examiner* — Kien Nguyen
(74) *Attorney, Agent, or Firm* — Brient Globerman, LLC; Kyle M. Globerman

(57) ABSTRACT

A movable screen apparatus suitable for use in a themed entertainment environment. The movable screen apparatus includes a screen and a base configured for movement over surface. The movable screen apparatus includes a guidance arrangement and a drive arrangement, wherein said guidance and drive arrangements are operable, in use, to move the screen apparatus along a pre-defined looped path. The looped path is defined by a physical track which is contactable by the guidance arrangement.

21 Claims, 4 Drawing Sheets

(56) References Cited

U.S. PATENT DOCUMENTS

| | | | | |
|---|---|---|---|---|
| 5,845,434 | A * | 12/1998 | Hayashi | E04H 14/00 472/59 |
| 6,865,023 | B2 * | 3/2005 | Shafer | G09F 19/18 353/122 |
| 8,137,205 | B2 | 3/2012 | Cortelyou et al. | |
| 2010/0053029 | A1 | 3/2010 | Wilzbach et al. | |
| 2013/0079167 | A1 | 3/2013 | Hasenzahl | |

OTHER PUBLICATIONS

International Search Report, dated Jan. 19, 2015, from corresponding Application Serial No. PCT/GB2014/053397.

* cited by examiner

MOVABLE SCREEN

The present invention relates to a movable screen, and particularly to a movable screen forming part of an amusement apparatus. More specifically, the present invention relates to a movable screen which is synchronised with the movement of a passenger conveying apparatus in a themed entertainment environment.

Theme parks, amusement parks, film studio parks and the like typically include themed rides. In such rides, passengers embark upon a conveying apparatus at an embarkation location, are conveyed through a themed environment, and disembark at a disembarkation location. The themed environment may, for example, be themed in relation to a motion picture, a television show or series, or a historical period.

While travelling through the themed environment, the movement of the conveying apparatus is preferably synchronised with features of the themed environment. Features of the themed environment with which the movement of the passenger conveying apparatus may be synchronised include, but are not limited to, audio effects, visual effects, lighting effects, pyrotechnic effects, animatronics apparatuses, projections screens, stationary and/or moving prop items, water effects, smoke or vapour effects, wind effects, odour effects and actors.

U.S. Pat. No. 8,137,205 discloses a carousel for use in the themed environment of an amusement ride. The carousel includes a number of concave screens. The carousel and screens are rotatable about a fixed axis in order to synchronise with the movement of one or more passenger conveying apparatuses.

According to a first aspect of the present invention there is provided a movable screen apparatus, the movable screen apparatus including a screen and a base configured for movement over surface, wherein the movable screen apparatus includes a guidance arrangement and a drive arrangement, wherein further said guidance and drive arrangements are operable, in use, to move the screen apparatus along a pre-defined looped path, wherein the looped path is defined by a physical track which is contactable by the guidance arrangement.

The term looped path refers to a continuous path such that the movable screen is able to move around circuits of the path. The looped path may be of any shape.

The physical track may, for example, be defined by one or more raised rails. Alternatively, the physical track may be defined by one or more recessed channels. In such an embodiment, the guidance arrangement includes a guide member configured for engagement with the physical track. The guide member may comprise a wheel or roller.

Where the looped path is a physical track, the drive arrangement mat include a drive member configured for engagement with the physical track. The drive member may comprise a drive wheel or roller. In such an embodiment the drive and guidance arrangements may be combined.

Preferably, the base is provided with ground engaging formations which support the base for movement over a surface. For example, the base may be provided with a plurality of wheels.

In an alternative embodiment, the base of the movable screen apparatus may take the form of an automated guided vehicle or AGV. In such an embodiment, the pre-determined looped path may not be defined by a physical feature, such as a channel or rail, with which the base interacts. The path may, for example, be defined by instructions contained within the guidance system. Alternatively, the path may be defined by external reference makers located within the themed entertainment environment which are recognised by the guidance system. It will be appreciated that alternative means for defining a looped path for the AGV to follow may be provided.

The screen may be a projection screen which is configured to display images projected from a projector. The screen may be flat or curved. Alternatively, the screen may be configured so as to be able to generate images. For example the screen may be an LCD, LED, OLED, LEP or equivalent display medium display.

According to a second aspect of the present invention there is provided the combination of a movable screen apparatus of the type described and a looped path defined by a physical track.

Multiple movable screen apparatuses may be provided on the looped path.

The combination may further include a passenger conveying apparatus, the passenger conveying apparatus being movable past the looped path, and movement of the passenger conveying apparatus is synchronised with movement of the movable screen apparatus and the display of images on the screen as the passenger conveying apparatus passes the looped path.

The passenger conveying apparatus may include a multi axial manipulator. The passenger conveying apparatus may be an AGV.

According to a third aspect of the present invention there is provided a themed environment including a movable screen apparatus as described above, a looped path and a passenger conveying apparatus, wherein the movable screen apparatus is movable around the looped path within the themed environment, the passenger conveying apparatus is movable through the themed environment past the looped path, and movement of the passenger conveying apparatus and the display of images on the screen is synchronised with movement of the movable screen apparatus as the passenger conveying apparatus passes the looped path.

The passenger conveying apparatus may include a multi axial manipulator. The passenger conveying apparatus may be an AGV.

An embodiment of the invention will now be described with reference to the accompanying drawings in which.

Figure 1:
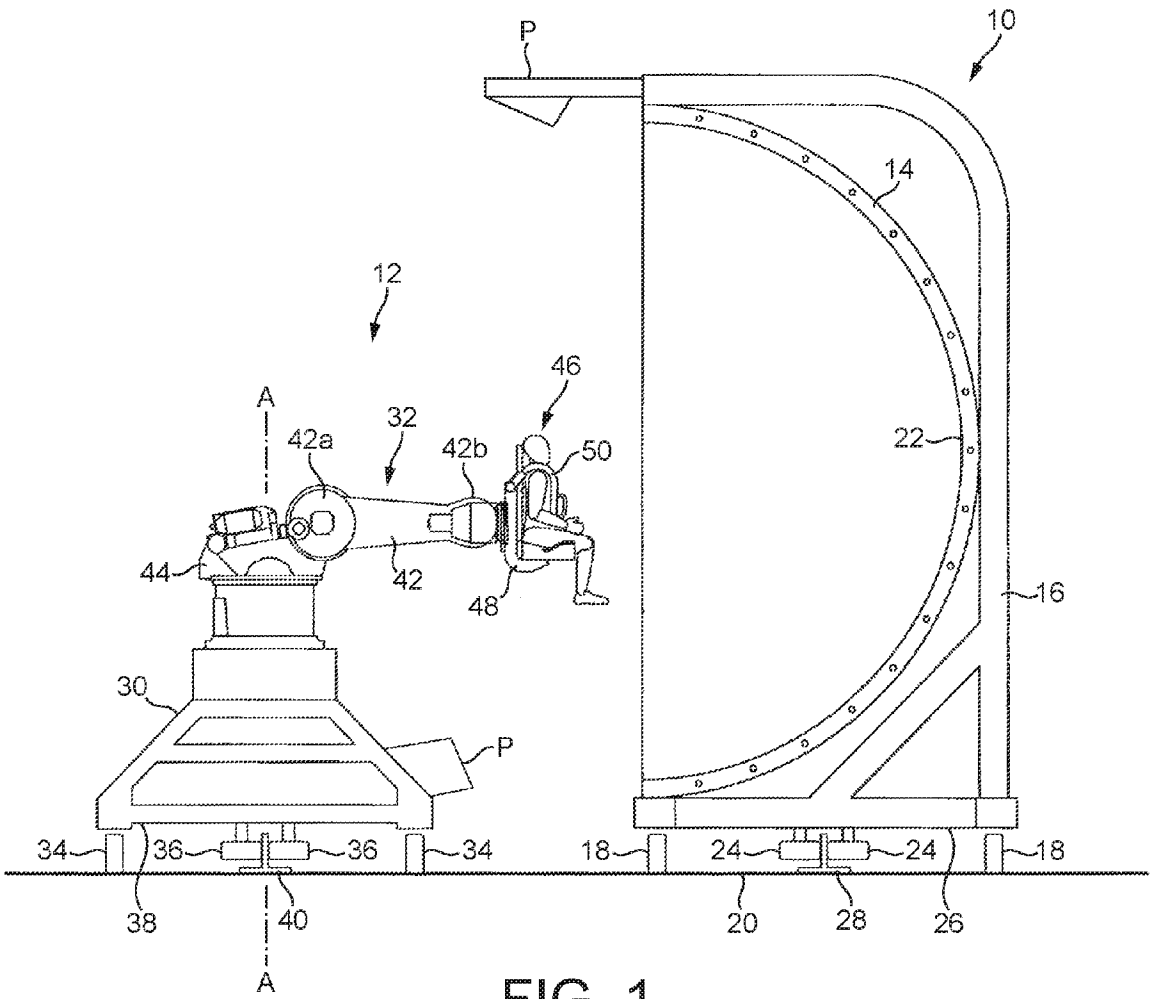
FIG. 1 is a side view of a movable screen according to the present invention and a passenger conveying apparatus.
Figure 2:
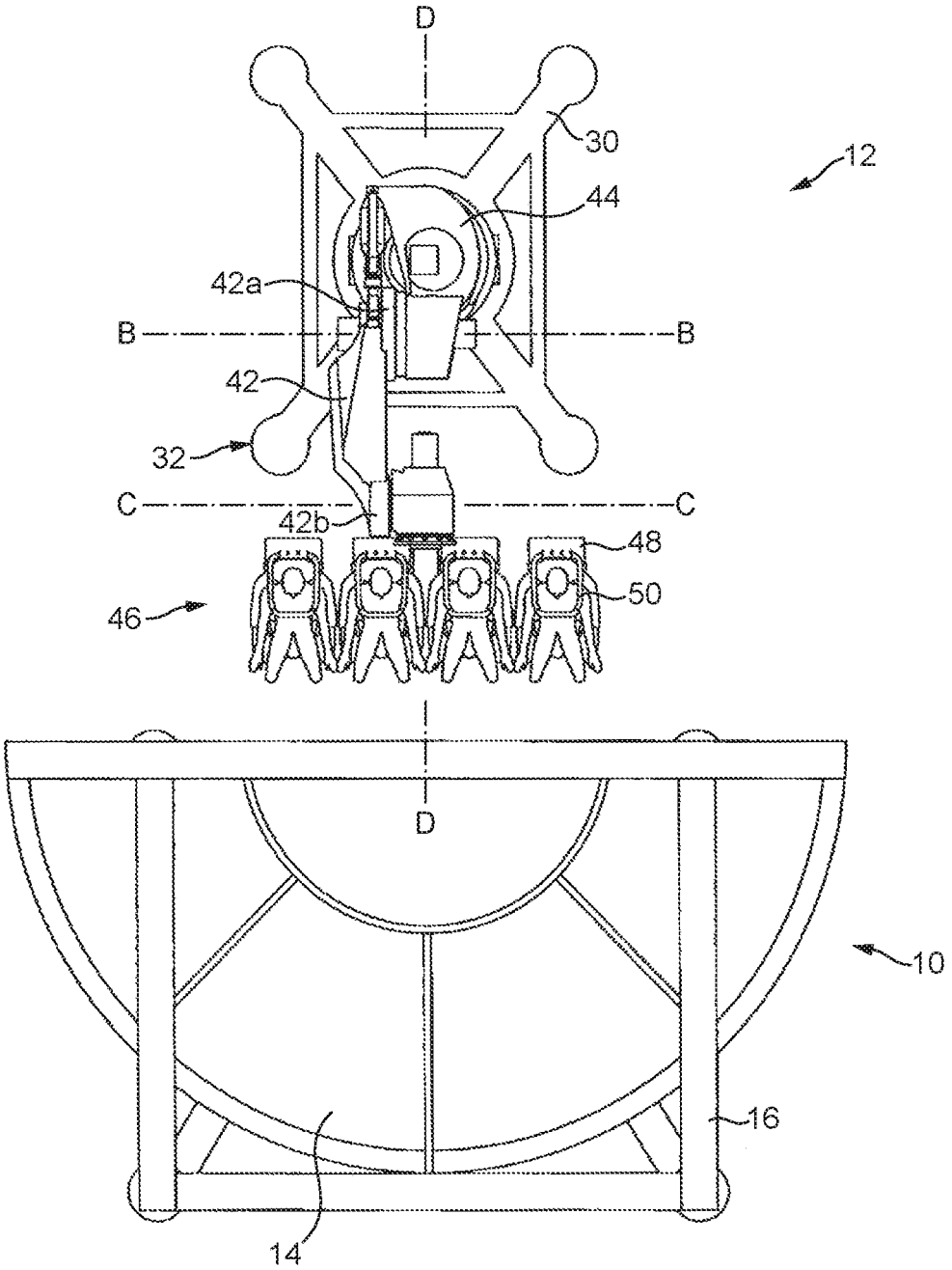
FIG. 2 shows a top plan view of the movable screen and passenger conveying apparatus of FIG. 1.

Referring firstly to FIGS. 1 and 2 there is shown a movable screen apparatus generally designated 10 and a passenger conveying apparatus generally designated 12. The movable screen 10 includes a concave screen 14 and a support frame 16. The support frame 16 includes a plurality of wheels 18 which enable the movable screen apparatus 10 to be moved over a support surface 20. The concave screen 14 includes a concave projection surface 22 upon which still and/or moving images can be projected from a projector (P). The projector (P) may, for example, be mounted on the support frame 16 or the passenger conveying apparatus 12. In an alternative embodiment the screen 14 may be configured to display images without the need for a projector. For example, the screen 14 may be an LCD, LED, OLED, LEP or equivalent display medium display. It will further be appreciated that the screen 14 may have a shape other than the concave shape shown in the accompanying figures. For example, the screen 14 may be curved in an alternative manner or be substantially flat.

The support frame 16 is further provided with a pair of combined guide and drive rollers 24. The rollers 24 are provided on the underside 26 of the frame 16 and cooperate with a guide rail 28 located upon the support surface 20 over which the movable screen apparatus 10 moves, in use. Both rollers 24 may be driven. In such an embodiment, each roller 24 is connected to a drive means such as, for example, an electric motor. In an alternative embodiment only one of the rollers 24 may be driven. In such an embodiment the other of the rollers 24 functions as an idler roller. The or each roller 24 has a surface that frictionally engages the guide rail 28. It will thus be understood that rotation of the or each driven roller 24 results in movement of the movable screen 10 over the support surface 20. The path along which the movable screen 10 travels is defined by the guide rail 28.

The passenger conveying apparatus 12 includes a chassis 30 and a multi axial manipulator 32. The chassis 30 includes a plurality of wheels 34 which enable the passenger conveying apparatus to be moved over the support surface 20. The passenger conveying apparatus is further provided with a pair of combined guide and drive rollers 36. The rollers 36 are provided on the underside 38 of the chassis 30 and cooperate with a guide rail 40 located upon the support surface 20 over which the passenger conveying apparatus moves, in use.

Both rollers 36 may be driven. In such an embodiment, each roller 36 is connected to a drive means such as, for example, an electric motor. In an alternative embodiment, only one of the rollers 36 may be driven. In such an embodiment the other of the rollers 36 functions as an idler roller. The or each roller 36 has a surface that frictionally engages the guide rail 40. It will thus be understood that rotation of the or each driven roller 36 results in movement of the passenger conveying apparatus 12 over the support surface 20. The path along which the passenger conveying apparatus 12 travels is defined by the guide rail 40.

The multi axial manipulator 32 includes an arm 42, a base 44 and a passenger carriage 46. The base 44 is rotatably mounted to the chassis 30 such that manipulator 32 is rotatable relative to the chassis 30 about a first axis A-A. The arm 42 is pivotably mounted to the base 44 at a first end 42*a* such that it is pivotable relative to the base about a second axis B-B. Axis B-B is substantially perpendicular to axis A-A.

The opposite end 42*b* of the arm 42 is both pivotably and rotatably connected to the passenger carriage 46. The passenger carriage 46 is pivotably connected to the arm 42 about a third axis C-C. The third axis C-C lies substantially parallel to the second axis B-B. The passenger carriage 46 is further rotatable about a fourth axis D-D. The fourth axis D-D is aligned with the longitudinal axis of the arm 42 and further lies substantially perpendicular to the second and third axes B-B, C-C. The manipulator 32 is provided with actuators to effect rotation and pivoting movement, as appropriate, about the axes A-A, B-B, C-C and D-D.

In the embodiment shown, the passenger carriage 46 includes four passenger seats 48. Each passenger seat 48 includes a passenger restraint 50.

In use, the movable screen apparatus 10 and passenger conveying apparatus 12 form part of an amusement ride. The passenger conveying apparatus 12 conveys passengers from a passenger embarkation point, through a themed environment, to a passenger disembarkation point. The embarkation point, themed environment and disembarkation point may be fully indoors, fully outdoors, or partially indoors and partially outdoors. As noted above, the movement path of the passenger conveying apparatus 12 is defined by the guide rail 40. In a preferred embodiment the passenger conveying apparatus guide rail 40 is in the form of a closed loop, and thus the passenger conveying apparatus 12 is able to circulate around the loop. In such an embodiment the passenger conveying apparatus 12 can thus conveys passengers from the passenger embarkation point, through the themed environment, to the passenger disembarkation point on a first portion of the loop. The passenger conveying apparatus 12 can thereafter move from the disembarkation point back to the passenger embarkation point on the remainder of the loop. Multiple passenger conveying apparatuses 12 may be provided in spaced apart relation to one another on the loop.

As the passenger conveying apparatus 12 moves through the themed environment its movement is synchronised with features of the environment. Features of the themed environment with which the passenger conveying apparatus 12 may be synchronised include, but are not limited to, audio effects, visual effects, lighting effects, pyrotechnic effects, animatronics apparatuses, projections screens, stationary and/or moving prop items, water effects, smoke or vapour effects, wind effects, odour effects and actors.

The movable screen apparatus 10 is located within the themed environment, and movement of the movable screen apparatus 10 is synchronised with movement of the passenger conveying apparatus 12.

Figure 3:
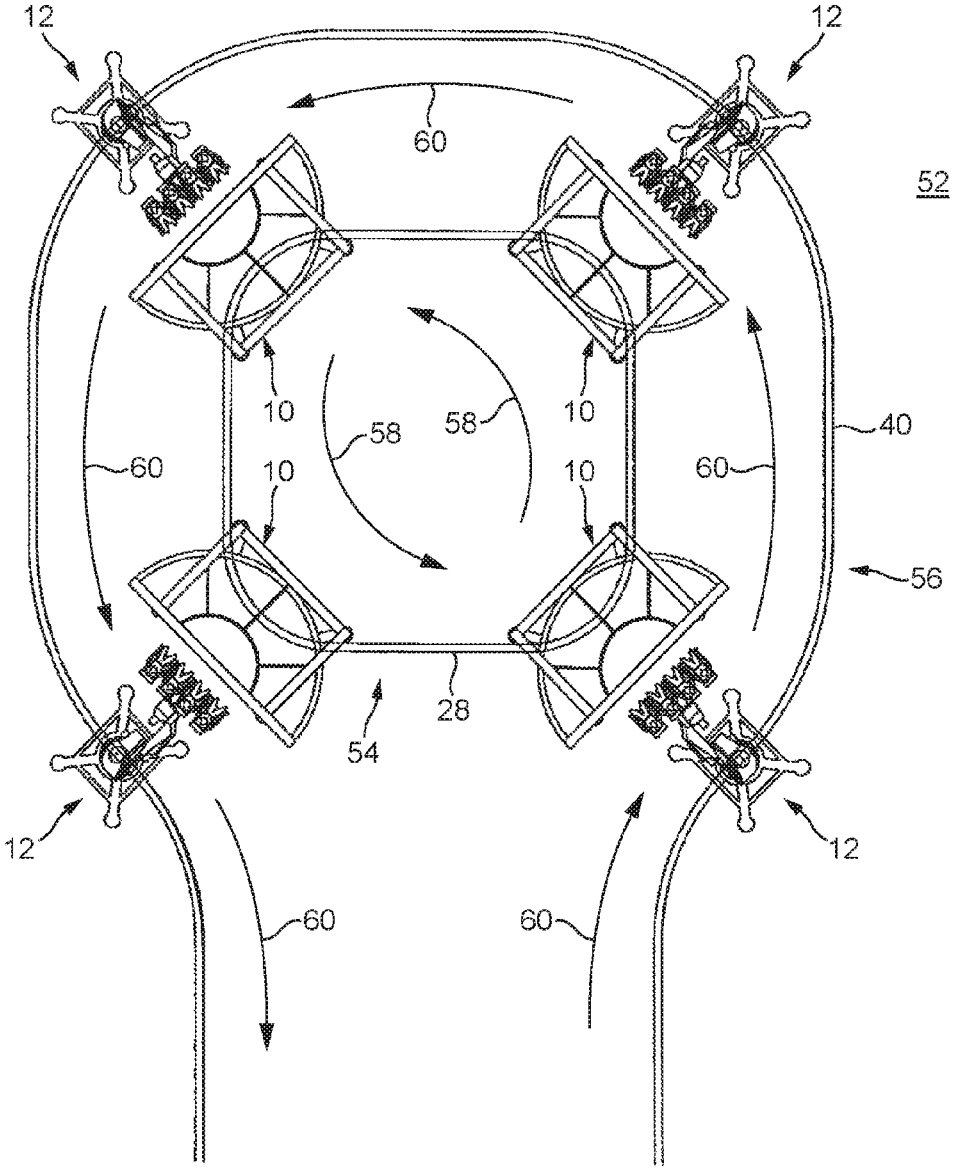
FIG. 3 shows a top plan view of a plurality of movable screens, a plurality of passenger conveying apparatuses and guidance tracks in a first configuration.
Figure 4:
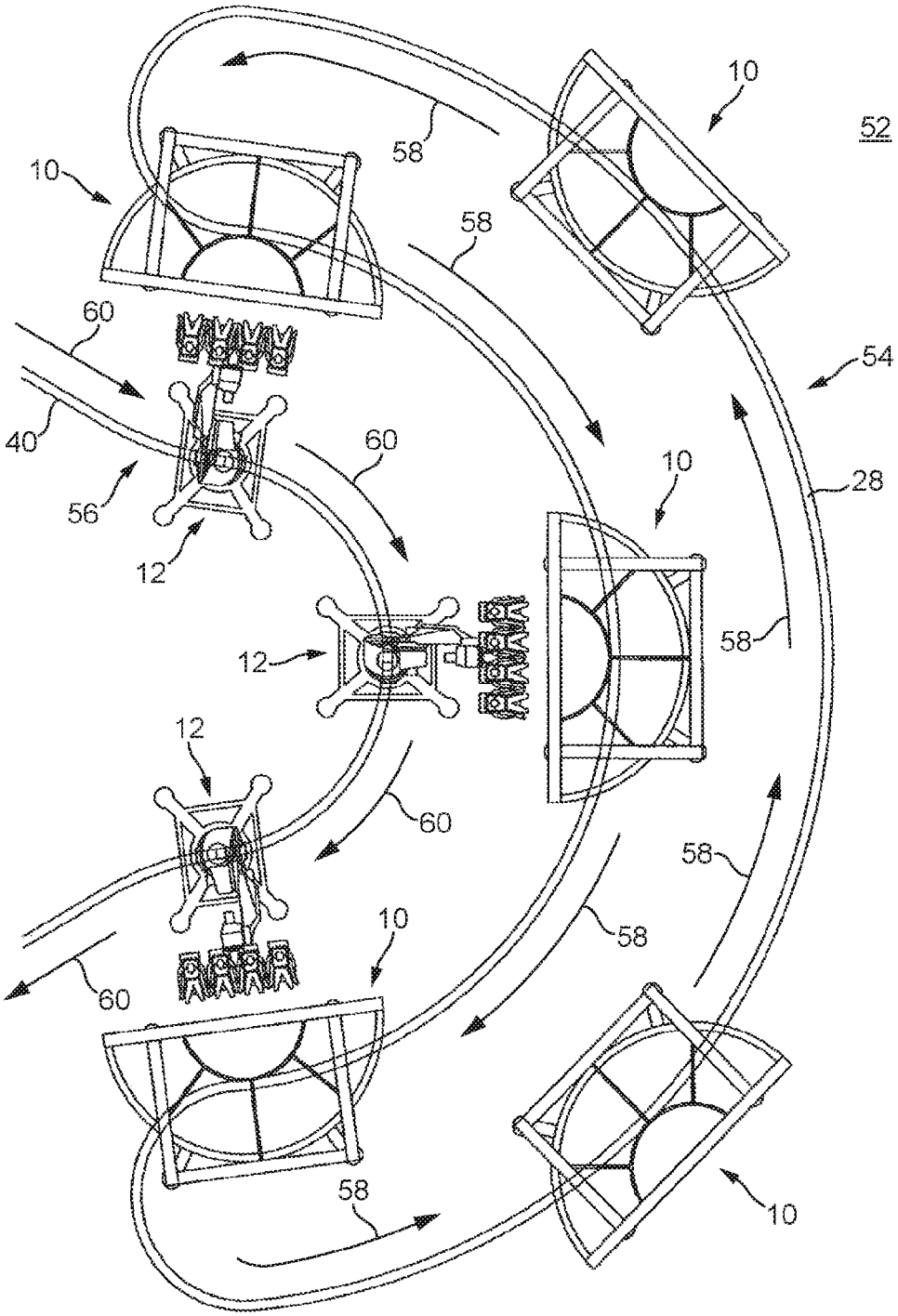
FIG. 4 shows a top plan view of a plurality of movable screens, a plurality of passenger conveying apparatuses and guidance tracks in an alternative configuration.

FIGS. 3 and 4 show top plan views of a portion of a themed environment, generally designated 52. In FIG. 3 there is shown a length of the passenger conveying apparatus guide rail 40 forming part of passenger conveying apparatus guide rail loop 56. There is also shown a length of the movable screen guide rail 28 which is formed into a closed loop 54. The screen guide rail loop 54 is in the form of a squircle. The passenger conveying apparatus guide rail loop 56 extends around substantially three sides of the screen guide rail loop 54. The screen guide rail loop 54 is thus located to the interior of the passenger conveying apparatus guide rail loop 56. The screen apparatuses 10 and passenger conveying apparatuses 12 are provided with appropriate control systems to ensure that sufficient separation of individual units is maintained on the respective loops 54,56, and that the motion of the screen apparatuses 10 and passenger conveying apparatuses 12 are synchronised at appropriate times.

In the embodiment shown in FIG. 3, the screen guide rail loop 54 is provided with four movable screen apparatuses 10. The part of the passenger conveying apparatus guide rail loop 54 shown is provided with four passenger conveying apparatuses 12. The movable screen apparatuses 10 circulate in a counter clockwise direction as indicated by arrows 58. The passenger conveying apparatuses 12 also move in a counter clockwise direction as indicated by arrows 60.

The movement of both the screen apparatuses 10 and passenger conveying apparatuses 12 are synchronised such that the passenger carriage 46 of each conveying apparatus faces the projection surface 22 of a concave screen 14. Passengers conveyed by a passenger conveying apparatus 12 can thus experience images projected onto the projection surface 22.

FIG. 4 shows an alternative configuration for the themed environment 52. Features common to the embodiment of FIG. 3 are identified with like reference numerals. The configuration of FIG. 4 differs in that the screen guide rail loop 54 is provided to the exterior of the passenger conveying apparatus guide rail loop 56. The screen guide rail loop 54 is substantially kidney shaped. The screen apparatuses 10 circulate in a counter clockwise direction as indicated by arrows 58. The passenger conveying apparatuses 12 circulate in a clockwise direction as indicated by arrows 60.

By providing individually movable screen apparatuses 10 on a looped track, it will appreciated that the screens 10 are better able to synchronise with the movement of the passenger conveying apparatuses 12. For example, the movement speed of a screen apparatus 10 may increase or decrease so as to match similar changes in speed of a conveying apparatus 12. It will further be appreciated that a screen apparatus 10 may be moved a first range of speeds when synchronised with the movement of a conveying apparatus 12 and moved at a second range of speeds when not synchronised with the movement of a conveying apparatus 12. As such, a screen may be accelerated around the guide track to a start position after a synchronisation period with a conveying apparatus 12 has ended.

The track 28 upon which the screens 10 are movable can be shaped to meet the individual requirements of a given installation. Movable screens 10 can thus be provided at a location where there is insufficient space of a carousel of screens. Individual screens 10 can be removed from the loop 54, for example for the purposes of maintenance and/or repair.

In the embodiments shown, the movable screens 10 include a concave projection screen 14. It will be appreciated that other types of screen may be utilised without departing from the scope of the present invention. For example, flat or planar, or concave projection screens may be used. The screen may also, for example, not be of the projection type. Instead, the screen may be capable of displaying moving images in a self-contained manner. In such an embodiment, the screen may be an LCD screen.

In the embodiments shown, the movable screens 10 and passenger conveying apparatuses 12 each follow a path defined by a single raised track 28,40. It will be appreciated that other track configurations are possible without departing from the scope of the present invention. For example, multiple tracks may be utilised. The or each track may be defined be recessed channels. In yet a further embodiment, the movable screen apparatuses 10 and/or passenger conveying apparatuses 12 may include automated guided vehicles know by the acronym AGV. The movement of such vehicles is not governed by a physical track, but by a track defined by other means. Such means may, for example, comprise instructions provided to an onboard guidance system of the AGV.

In the embodiment shown, the passenger conveying apparatus 12 includes a multi axial manipulator 32. It will be understood that other configurations of passenger conveying apparatus 12 may be used.

What is claimed is:

1. A themed or dark-ride environment comprising a movable screen apparatus comprising a screen and a base configured for movement over a surface, wherein the movable screen apparatus includes a guidance arrangement and a drive arrangement, characterized in that said guidance and drive arrangements are operable, in use, to circulate the screen apparatus around a pre-defined looped path, wherein the looped path is defined by a physical track which is contactable by the guidance arrangement; and a passenger conveying apparatus, wherein the movable screen apparatus is movable around the looped path within the themed environment, the passenger conveying apparatus is movable through and themed environment past the looped path, and movement of the passenger conveying apparatus and the display of images on the screen is synchronized with movement of the movable screen apparatus as the passenger conveying apparatus passes the looped path.

2. The themed or dark-ride environment as claimed in claim 1 wherein the physical track is defined by one or more raised rails.

3. The themed or dark-ride environment as claimed in claim 1 wherein the physical track is defined by one or more recessed channels.

4. The themed or dark-ride environment as claimed in claim 1 wherein the guidance arrangement includes a guide member configured for contact with the physical track.

5. The themed or dark-ride environment as claimed in claim 4 wherein the guide member includes a wheel or roller.

6. The themed or dark-ride environment as claimed in claim 1 wherein the drive arrangement includes a drive member configured for contact with the physical track.

7. The themed or dark-ride environment as claimed in claim 6 wherein the drive member includes a wheel or roller.

8. The themed or dark-ride environment as claimed in claim 7 wherein the guide member comprises a wheel or roller and the drive member wheel or roller is combined with the guide member wheel or roller.

9. The themed or dark-ride environment as claimed in claim 1 wherein the base is provided with ground engaging formations which support the base for movement over a surface.

10. The themed or dark-ride environment as claimed in claim 9 wherein the base may be provided with a plurality of wheels.

11. The themed or dark-ride as claimed in claim 1 wherein the screen is a projection screen which is configured to display images projected from a projector.

12. The themed or dark-ride environment as claimed in claim 11 wherein the projector is provided upon the movable screen apparatus.

13. The themed or dark-ride environment as claimed in 1 wherein the screen is configured so as to be able to generate images for display.

14. The themed or dark-ride environment as claimed in claim 13 wherein the screen is an LCD, LED, OLED, LEP or equivalent display medium display.

15. The themed or dark-ride environment as claimed in claim 1 wherein the screen is flat.

16. The themed or dark-ride environment as claimed in claim 1 wherein the screen curved.

17. The themed or dark-ride environment as claimed in claim 16 wherein the screen is concave.

18. The themed or dark-ride environment as claimed in claim 1 wherein multiple movable screen apparatuses are provided on the physical track.

19. The themed or dark-ride environment as claimed in claim 1 wherein the passenger conveying apparatus includes a multi axial manipulator.

20. The themed or dark-ride environment as claimed in claim 1 wherein the passenger conveying apparatus includes a multi axial manipulator.

21. The themed or dark-ride environment as claimed in claim 1 wherein passenger conveying apparatus is an AGV.

* * * * *